US007053738B2

(12) United States Patent
Hoffmann et al.

(10) Patent No.: US 7,053,738 B2
(45) Date of Patent: May 30, 2006

(54) RELAY AND PROCESS FOR PRODUCING A RELAY

(75) Inventors: Ralf Hoffmann, Berlin (DE); Thomas Haehnel, Berlin (DE); Ralf Gollee, Berlin (DE); Joerg Schultheiss, Rehbrueeke (DE); Olaf Abel, Potsdam (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/056,039

(22) Filed: Feb. 11, 2005

(65) Prior Publication Data

US 2005/0190027 A1 Sep. 1, 2005

(30) Foreign Application Priority Data

Feb. 11, 2004 (DE) ..... 10 2004 006 710

(51) Int. Cl.
*H01H 51/22* (2006.01)

(52) U.S. Cl. ..... 335/83; 335/129

(58) Field of Classification Search ..... 335/78–86, 335/128–131, 124, 202; 439/810–814
See application file for complete search history.

(56) References Cited

U.S. PATENT DOCUMENTS

| | | | | |
|---|---|---|---|---|
| 4,734,668 | A | 3/1988 | Dittmann | 335/128 |
| 4,803,589 | A | 2/1989 | Kimpel | 361/210 |
| 4,914,411 | A | 4/1990 | Hikita et al. | 335/128 |

*Primary Examiner*—Lincoln Donovan
(74) *Attorney, Agent, or Firm*—Barley Snyder LLC

(57) ABSTRACT

A relay and a process for producing a relay are described, three contact pins being provided for the relay. The three contact pins are preferably manufactured from a stamping and are fixed together as a contact stamping with respect to a yoke through insertion into a base. As a result of the use of a contact stamping with the three contact pins connected rigidly to one another, adjustment and handling of the three contact pins during production of the relay is relatively simple.

6 Claims, 3 Drawing Sheets

RELAY AND PROCESS FOR PRODUCING A RELAY

FIELD OF THE INVENTION

The invention relates to a relay and a process for producing a relay wherein contact pins are stamped and then separated during assembly.

BACKGROUND

Relays are known in the widest possible number of configurations and are used for example in automotive engineering applications in order to switch electrical currents. In such automotive engineering applications, in particular, it is necessary to provide relays with a compact construction which are also economical to produce.

The relays known from the prior art have a relatively complex construction and precision manufacture of the relays is relatively expensive since specified tolerances for the arrangement of the individual parts of the relay must be adhered to exactly.

What is needed is a relay having a simplified construction that is simple and economical to produce.

SUMMARY

The invention is a relay having a magnetic coil, a yoke, and an armature. A movable contact is supported on the armature. First and second contact pins for passing a load current are switched by the movable contact. Two contacts are provided on the magnetic coil, a first one of the coil contacts being connected to the first or the second contact pin. A third contact pin is connected to a second one of the magnetic coil contacts. The three contact pins are stamped and are fixed together as a contact stamping, inserted into a base, aligned and then separated from each other to facilitate assembly.

BRIEF DESCRIPTION OF THE DRAWINGS

The invention will now be described with reference to the drawings, in which:

FIG. 1 shows a perspective illustration of a relay with a removed protective cap 11. The relay has a base 9, which consists of an insulating material and into which three contact pins 4, 12, 13 are inserted and held. A magnetic circuit with a magnetic coil 2 and U-shaped yoke 1 is also held in the base 9. The yoke 1 has first and second yoke legs 14, 15, which are arranged in parallel relative to each other and are held in the base 9. An L-shaped armature 3 (FIG. 4) lies against the first yoke leg 14. Above the base 9, a movable spring contact 5 is arranged in parallel to a base plate 10. The spring contact 5 is attached at a right end to the second contact pin 12 using a suitable fastener, for example one or more rivets. The spring contact 5 is furthermore attached in a central region to the armature 3. A freely movable second end of the spring contact 5 is associated with the first contact pin 4. The magnetic coil 2 has a coil housing 16, on which a support projection 8 is arranged. The support projection 8 overlaps the spring contact 5, which is thus arranged between the support projection 8 and the second yoke leg 15. The support projection 8 serves as a support for the spring contact 5 when the magnetic coil 2 is de-energized thus defining an open position of the spring contact 5.

Figure 1:
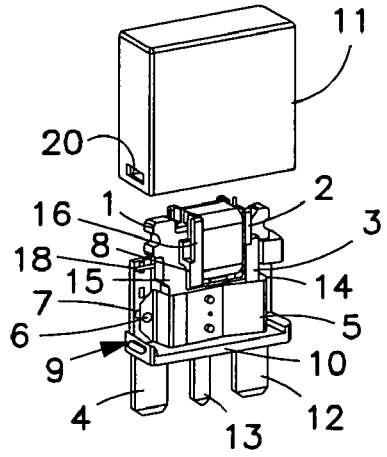
FIG. 1 is a perspective view of a relay with a removed protective cap.

The spring contact 5 has at its freely movable end a contact rivet, which is associated with a contact rivet of the first contact pin 4. On energization of the magnetic coil 2 the armature 3 is drawn with its movable side in the direction of the second yoke leg 15. The spring contact 5 is thereby drawn with its movable end in the direction of the first contact pin 4, with the result that the two contact rivets of the first contact pin 4 and the spring contact 5 are engaged. An electrically conductive connection between the first contact pin 4 and the second contact pin 12 is thus produced via the spring contact 5.

In the embodiment shown, the first contact pin 4 is connected to a first contact 18 of the magnetic coil 2. The third contact pin 13 is connected to a second contact 19 (FIG. 3) of the magnetic coil 2, the second contact 19 extends perpendicular to the contact rivet 6. The third contact pin 13 is arranged between the first and the second contact pin 4, 12 and held in the base 9. The third contact pin 13 serves only for the electrical contact of the second contact 19 of the magnetic coil 2.

Located on narrow lateral edges of the base plate 10 are latching projections 9, which engage in recesses 20 of the protective cap 11 when the protective cap 11 is applied to the base plate 10.

Figure 2:
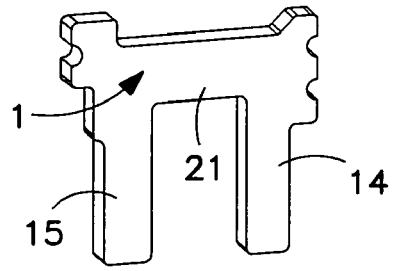
FIG. 2 is a perspective view of a U-shaped yoke.

FIG. 2 shows the U-shaped yoke 1 with the first and the second yoke leg 14, 15. The first and the second yoke leg 14, 15 are arranged in parallel to each other and lie in a common plane. The first and the second yoke leg 14, 15 are connected to each other via a connection piece 21. The connection piece 21 is arranged between and generally orthogonal to the first and the second yoke leg 14, 15.

Figure 3:
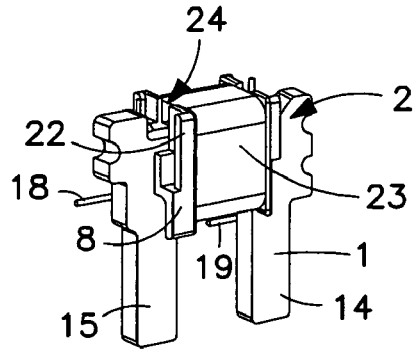
FIG. 3 is a perspective view of the U-shaped yoke with the magnetic coil.

FIG. 3 shows the yoke 1 with the magnetic coil 2, which has a laterally open coil body 22 and a coil 23 with the first and the second contact 18, 19. The coil body 22 has an insertion opening 24, via which the coil body 22 is pushed onto the connection piece 21 during assembly. Only then is the coil 23 wound onto the coil body 22, which is already located on the yoke 1. The coil body 22 has the support projection 8, which is arranged in the region in front of the second yoke leg 15 as described above.

Figure 4:
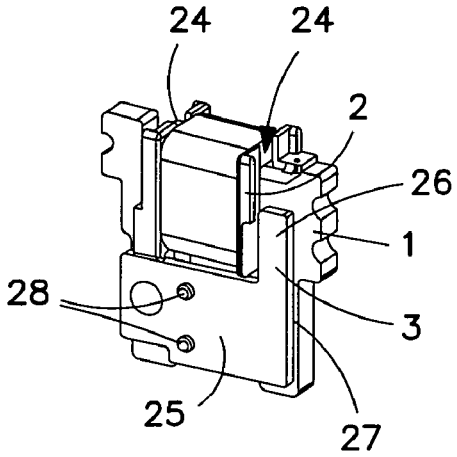
FIG. 4 is a perspective view of the U-shaped yoke with the magnetic coil and an L-shaped armature.

FIG. 4 shows the yoke 1 with the magnetic coil 2 and the L-shaped armature 3. In this illustration the insertion opening 24 of the coil body 22 can be seen clearly. The armature 3 has an armature plate 25, which is substantially rectangular and is arranged with end regions over the two yoke legs 14, 15. The armature plate 25 extends to an armature leg 26, which is aligned substantially in parallel to the first yoke leg 14 and extends upwards above the center of the connection piece 21. The armature leg 26 and the armature plate 25 form a supporting edge 27, with which the armature 3 lies against the first yoke leg 14. The end of the armature plate 25 opposing the supporting edge 27 is the movable end of the armature 3, with which a magnetic circuit to the second yoke leg 15 can be completed. The armature plate 25 has fasteners such as rivets 28 by means of which the spring contact 5 is attached to the armature 3.

Figure 5:
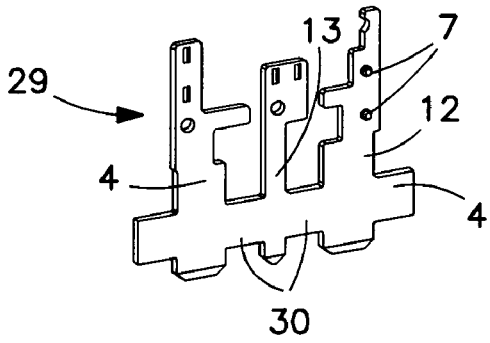
FIG. 5 is a perspective view of a stamping with three contact pins.

FIG. 5 shows a stamping 29 which includes the first, the second and the third contact pin 4, 12, 13, being connected to one another by retention pieces 30. The stamping 29 is stamped out from a metallic sheet in a stamping operation. The three contact pins 4, 12 13 are thus connected rigidly to one another and are arranged in a common plane. Easy handling of the three contact pins 4, 12, 13 during assembly and adjustment is thereby ensured. Further rivets 7 are provided in the second contact pin 12, by means of which the spring contact 5 is attached to the second contact pin 12 after assembly of the armature 3 on the spring contact 5.

Figure 6:
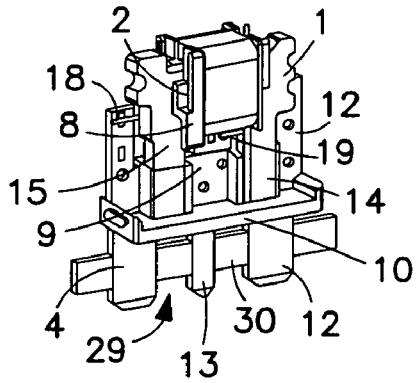
FIG. 6 shows a partially-assembled relay.

FIG. 6 shows an assembly step in which the yoke 1 with the magnetic coil 2 and the stamping 29 are held with one another in the base 10. In this assembly step, the stamping 29 still has the retention pieces 30, which are later removed by punching. After removal of the retention pieces, through the stamping 29, the first contact 18 and the second contact 19 are electrically connected with the first contact pin 4 and the third contact pin 13 respectively. Use of the stamping 29 affords an advantage in the adjustment of the yoke 1 and of the three contact pins 4, 12, 13 because only two parts must be fixed to each other. The base 9 is preferably configured in the form of an injection molded part. As an injected molded part, reliable adjustment and dependable retention of the yoke 1 and of the three contact pins 4, 12, 13 is facilitated.

Figure 7:
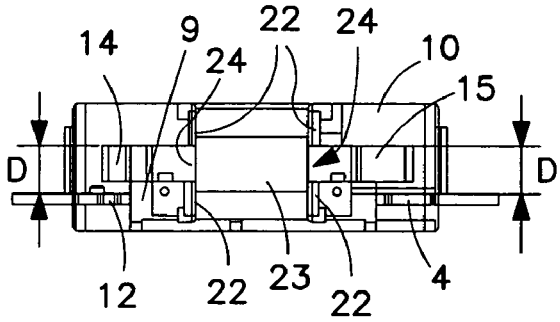
FIG. 7 is a perspective view from above onto the partially-assembled relay.

FIG. 7 shows a view from above onto the arrangement of FIG. 6 wherein the planes of the yoke 1 and of the contact pins 4, 12, 13 being clearly visible, are arranged in parallel to each other. A desired distance D between the yoke 1 and the contact pins 4, 12, 13 can thus be set. Achieving a precise distance D in assembly is desirable because of the precise adjustment between the armature 3 and the spring contact 5. FIG. 7 also shows the insertion opening 24 in the coil body 22, through which the connection piece 21 has been inserted laterally into the coil body 22 and only then was the coil 23 attached to the coil body 22.

Figure 8:
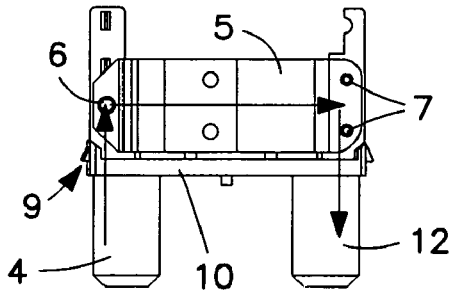
FIG. 8 is a schematic illustration of the load current path.

FIG. 8 shows a schematic illustration of the current path to be switched, wherein the current flows via the first contact pin 4 upwards into the relay and is conducted via contact rivets 6, 7 to the spring contact 5 when the magnetic coil 2 is energised. From the spring contact 5, the current is conducted to the second contact pin 12. The load current path is illustrated schematically in FIG. 8 in the form of arrows. The spring contact 5 is held on the second contact pin 12 via the further rivets 7.

Figure 9:
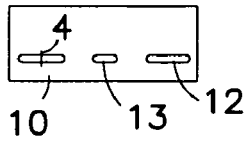
FIG. 9 is a bottom end view of the relay.

FIG. 9 shows a view from below of the relay with a view of the base plate 10 and the first, the second and the third contact pin 4, 12, 13. In this embodiment it is clearly visible that the three contact pins 4, 12, 13 have the same thickness and are arranged in a common plane. The third contact pin 13, as shown in FIG. 9, is preferably formed with a smaller width.

Figure 10:
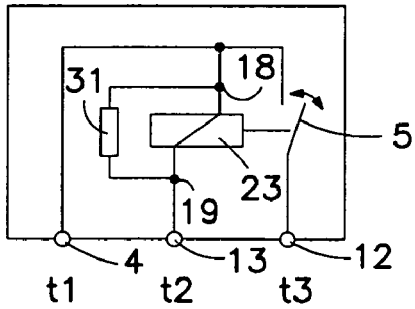
FIG. 10 is an electrical equivalent circuit diagram for the circuit of the contact pins.

FIG. 10 shows an electrical equivalent circuit diagram for the circuit of the first, the second and the third contact pin 4, 12, 13. The first contact pin 4 is electrically connected so as to form a conductive path through the first contact 18 to the coil 23 of the magnetic coil 2 then through the second contact 19 of the coil 23. A resistance 31 is connected in parallel with the coil 23 of the magnetic coil 2. The second contact pin 12 is connected so as to form a conductive path to the spring contact 5, which is arranged either in an open position, as shown in FIG. 10, or in a closed position, as a function of the magnetic coil 2 energization. When the spring contact 5 is in the open position there is no electrically flowing between the first and the second contact pin 4, 12. If the magnetic coil 2 is energized, the armature 3 and thus the spring contact 5 is drawn into the closed position such that the spring contact 5 closes an electrically conductive connection between the first and the second contact pin 4, 12.

An advantage of the relay is that only three contact pins 4, 12, 13 are provided for supplying the magnetic circuit and for providing a load current path to be switched. A simplified construction of the relay is thereby achieved. Since the three contact pins 4, 12, 13 are arranged in a common plane, a particularly narrow configuration of the relay is thus achieved. This is advantageous in a vehicle in particular, as the space available is limited.

Since the yoke 1 of the relay has a U-shape, the legs 14, 15 are arranged in a plane parallel to the plane of the contact pins 4, 12, 13. During production of the relay only the distance of the two planes must thus be adjusted precisely in order to achieve the required functionality of the relay.

The third contact pin 13 is advantageously provided, only to supply the magnetic coil 2 of the relay. A second contact 18 of the magnetic coil 2 is provided by one of the two contact pins 14, 15 of the load current path. As a result of this arrangement a relatively large distance between the contact pins 14, 15 of the load current path is possible, with the result that, in the event of high voltages arcing is avoided.

The three contact pins 4, 12, 13 are advantageously manufactured from the same material and with the same thickness. The three contact pins 4, 12, 13 can thus be manufactured for example in a stamping operation from a metal sheet, the three contact pins 4, 12, 13 being connected to one another by retention strips 30 before assembly in the relay, such that simple adjustment on one plane of the three contact pins 4, 12, 13 is possible.

The first and the second contact pins 4, 12 have a greater width than the third contact pin 13. The three contact pins 4, 12, 13 are thus optimally sized according to the current to be conducted by each, with the result that there is a material saving with respect to the third contact pin 13 despite an identical thickness. It is thus possible to punch out the three contact pins from one sheet in one work stage.

The first and the second contact pin 4, 12 and the two yoke legs 14, 15 are fixed in a position relative to one another by the base 9, which is manufactured from an insulating material. Simple and precise adjustment of the two planes is thus advantageously ensured. The use of the injection-molding for the base enables simple and precise adjustment of the contact pins and the yoke legs relative to each other.

As a result of the arrangement of the movable contact 5 being directly above the base 9, a short load current path for the current to be switched is achieved within the relay. The heat loss occurring in the relay is thereby advantageously minimized.

The process according to the invention has the advantage that the three contact pins 4, 12, 13 can be manufactured as a single-piece stamping from one sheet and are thereby automatically adjusted relative to one another in a common plane during assembly of the relay. Precise adjustment of the contact pins 4, 12, 13 in a plane and easy handling of the contact pins during assembly of the relay are thus possible.

Simple and precise fixing of the yoke legs 14, 15 with respect to the contact pins is possible because they are fixed via an injection-moulded part to the yoke of the magnetic coil 2. This is therefore particularly advantageous as arranged on the yoke is the movable armature 3, which must have a defined position relative to the movable contact 5, as the movable contact 5 is supported on a contact pin and is furthermore attached to the armature 3. For correct functionality, both the armature 3 with respect to the legs 14, 15 and the movable contact 5 with respect to the contact pins must have a precise position.

What is claimed is:

1. A relay having a magnetic coil, a yoke, and an armature, the relay comprising:

a movable contact which is supported on the armature;

first and second contact pins for passing a load current to be switched by the movable contact;

two contacts provided on the magnetic coil, a first one of the coil contacts being connected to the first or the second contact pin; and a third contact pin, which is connected to a second one of the magnetic coil contacts;

wherein the three contact pins are arranged in a common plane;

wherein the yoke is U-shaped having two legs arranged in a plane parallel to the common plane of the contact pins; and wherein the third contact pin is arranged between the first and second contact pins.

2. The relay of claim 1 wherein the three contact pins are manufactured from the same material with the same thickness and the first and second contact pins have a greater width than the third contact pin.

3. The relay of claim 2 further comprising a base supporting the first, second and third contact pins and the two yoke legs.

4. The relay of claim 3 wherein the base is formed as an injection molded part.

5. The relay of claim 3 wherein the base has a base plate which seals the relay at the bottom.

6. The relay of claim 5 wherein the movable contact is arranged above and substantially in parallel with the base plate and is held at one of its ends on one of the contact pins.

* * * * *